US009301036B2

(12) United States Patent
Akino

(10) Patent No.: US 9,301,036 B2
(45) Date of Patent: Mar. 29, 2016

(54) MICROPHONE AND MICROPHONE DEVICE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/516,023

(22) Filed: Oct. 16, 2014

(65) Prior Publication Data

US 2015/0139453 A1 May 21, 2015

(30) Foreign Application Priority Data

Nov. 15, 2013 (JP) ..... 2013-236616

(51) Int. Cl.
*H04R 1/04* (2006.01)
*H04R 19/00* (2006.01)

(52) U.S. Cl.
CPC . *H04R 1/04* (2013.01); *H04R 19/00* (2013.01)

(58) Field of Classification Search
CPC ..... H04R 3/04; H04R 2410/00; H04R 1/08; H04R 3/00; H04R 3/007; H04R 1/04; H04R 19/04; H04R 3/002; H04R 29/08; G10K 11/1782
See application file for complete search history.

(56) References Cited

U.S. PATENT DOCUMENTS 5,796,850 A * 8/1998 Shiono ..... G10K 11/1782 330/149
2002/0186855 A1* 12/2002 Akino et al. ..... 381/111
2006/0083392 A1* 4/2006 Akino ..... 381/122
2006/0291672 A1* 12/2006 Akino ..... 381/111
2007/0230717 A1* 10/2007 Akino ..... 381/113
2011/0085683 A1* 4/2011 Ejaz ..... H04R 19/04 381/174
2012/0076325 A1* 3/2012 Akino ..... 381/113
2012/0224723 A1* 9/2012 Akino ..... 381/114
2013/0089222 A1* 4/2013 Akino ..... 381/111
2014/0112514 A1* 4/2014 Yoshino ..... 381/356

FOREIGN PATENT DOCUMENTS

JP 2001-238287 8/2001

* cited by examiner

*Primary Examiner* — Fan Tsang
*Assistant Examiner* — Angelica M McKinney
(74) *Attorney, Agent, or Firm* — Whitham, Curtis, Christofferson & Cook, P.C.

(57) ABSTRACT

A microphone comprises a microphone unit; and a HOT terminal and a COLD terminal that produce a balanced output of output signals of the microphone unit, and no filter circuit is disposed between the microphone unit and the HOT terminal and a low-pass filter is disposed only between the microphone unit and the COLD terminal.

8 Claims, 9 Drawing Sheets

MICROPHONE AND MICROPHONE DEVICE

TECHNICAL FIELD

The present invention relates to a microphone and a microphone device.

BACKGROUND ART

Outputs from a microphone (in particular, a condenser microphone) sometimes include wind noise and/or vibration noise. In order to reduce the noise, a filter circuit is disposed in a preceding stage of an output circuit of the microphone. Since the wind noise and vibration noise are mainly composed of low frequency components, the filter circuit used is a high-pass filter (a low-cut filter).

A condenser microphone has high output impedance. Thus, an impedance converter is provided on the output side of the condenser microphone to reduce the output impedance. The impedance converter mainly includes a field-effect transistor (FET). The high-pass filter that attenuates the low frequency components is disposed in a subsequent stage of the impedance converter and in a preceding stage of the output circuit of the microphone (refer to PTL 1, Japanese Unexamined Patent Application Publication No. 2001-238287).

FIG. 9 is a circuit diagram illustrating an example configuration of a conventional microphone. As shown in FIG. 9, a conventional microphone 100 includes a microphone unit 1 that is a condenser microphone unit, an impedance converter 2, a high-pass filter 30, and an output amplifier 4.

The output from the microphone 100 is a balanced output. The output terminal of the microphone 100 has therefore three pins, i.e., a HOT terminal 5, a COLD terminal 6, and a ground terminal 7. The HOT terminal 5 outputs a positive phase of output signal from the microphone unit 1. The COLD terminal 6 outputs a negative phase of output signal from the microphone unit 1.

In order to match the output impedance of the microphone unit 1 and the input impedance of the high-pass filter 30, it is necessary to reduce the input impedance of the high-pass filter 30 in accordance with the output impedance of the microphone unit 1 that has been lowered by the impedance converter 2. Unfortunately, such a reduction in input impedance of the high-pass filter 30 leads to distortion of output signals from the impedance converter 2.

The high-pass filter 30 also has high output impedance. Thus, a buffer amplifier including an emitter follower circuit with transistors is employed as the output amplifier 4 disposed in a subsequent stage of the high-pass filter 30. In the output amplifier 4, however, a noise level increases due to the high output impedance of the high-pass filter 30. The output impedance is high at frequencies below the cutoff frequency of the high-pass filter 30 and thus the noise level is significantly high at frequencies below the cutoff frequency of the high-pass filter 30.

The high-pass filter 30 includes a capacitor C30 connected in series with an output terminal of the microphone unit 1 and a resistor R30 connected in parallel with the output terminal of the microphone unit 1. If the frequency of the output signal from the microphone unit 1 is low, then the impedance of the capacitor C30 is dominant and the impedance of the high-pass filter 30 is high. Low frequency signals cannot therefore be output toward the output amplifier 4.

If the frequency of the output signal from the microphone unit 1 is high, the impedance of the capacitor C30 is low and high frequency signals can be output toward the output amplifier 4. The high-pass filter 30 outputs signal components with frequencies higher than a certain frequency and cuts off signal components with frequencies lower than the certain frequency. The boundary frequency of the signals output toward the output amplifier 4 in the high-pass filter 30 is called a cutoff frequency.

If the frequency of the output signal from the microphone unit 1 is higher than the cutoff frequency, then the impedance of the capacitor C30 is a negligible level. In this case, the impedance of the resistor R30 is dominant in the high-pass filter 30. When the frequency of the output signal from the microphone unit 1 is higher than the cutoff frequency, the output impedance toward the microphone unit 1 relative to the output amplifier 4 is approximately equal to the output impedance of the resistor R30. As the impedance of the resistor R30 increases, the noise level output from the microphone unit 1 increases. The impedance of the resistor R30 in the high-pass filter 30 is generally higher than the output impedance of the impedance converter 2. Thus, if the high-pass filter 30 is disposed in a preceding stage of the output amplifier 4, then the noise level output from the output amplifier 4 increases as the frequency of the output signal from the microphone unit 1 increases.

The output impedance of the output amplifier 4 corresponds to the output impedance of its preceding circuit multiplied by the reciprocal of the current amplification factor ($h_{FE}$) of the transistor used when the output amplifier 4 includes an emitter follower. Thus, in an example case that the high-pass filter 30 is not employed, at an output impedance of the microphone unit 1 of 10 Ω and an $h_{FE}$ of the transistor of 100, the output impedance of the output amplifier 4 is 1/10Ω. As described above, if the high-pass filter 30 is employed, at a frequency of the output signal of the microphone unit 1 higher than the cutoff frequency, the resistance component of the high-pass filter is dominant. Hence, the impedance of the microphone unit 1 relative to the output amplifier 4 depends on the value of the resistor R30 in the high-pass filter 30. Assuming that the resistance value of the resistor R30 is 10 kΩ, the output impedance of the output amplifier 4 is 1 kΩ in the above-mentioned case.

If the output impedance of the output amplifier 4 is 1 kΩ, then external noise having a frequency of approximately 50 Hz is electrostatically coupled with a microphone cord (not shown) and is readily output from the output amplifier 4. As a result, noise can be readily mixed into the output of the microphone unit 1.

In order to solve the above-mentioned problems, it is desirable to provide a microphone that does not produce distortions of outputs even if the impedance of a circuit connected to a subsequent stage of the impedance converter 2 is low. It is also desirable to provide a microphone that does not produce any noise due to the impedance of the filter circuit. In addition, it is desirable to provide a microphone that has low output impedance even if the frequency of the output signal is less than the cutoff frequency of the filter circuit.

SUMMARY OF INVENTION

Technical Problem

An object of the present invention is to provide a microphone that does not produce high output impedance regardless of the frequency of an output signal and that can have a large dynamic range.

Solution to Problem

The present invention is relates to a microphone including: a microphone unit; and a HOT terminal and a COLD terminal that produce a balanced output of output signals of the microphone unit, wherein no filter circuit is disposed between the microphone unit and the HOT terminal and a low-pass filter is disposed only between the microphone unit and the COLD terminal.

Advantageous Effects of Invention

According to the present invention, the output impedance does not increase regardless of the frequency regions of an output signal and the dynamic range is large.

DESCRIPTION OF EMBODIMENTS

Figure 1:
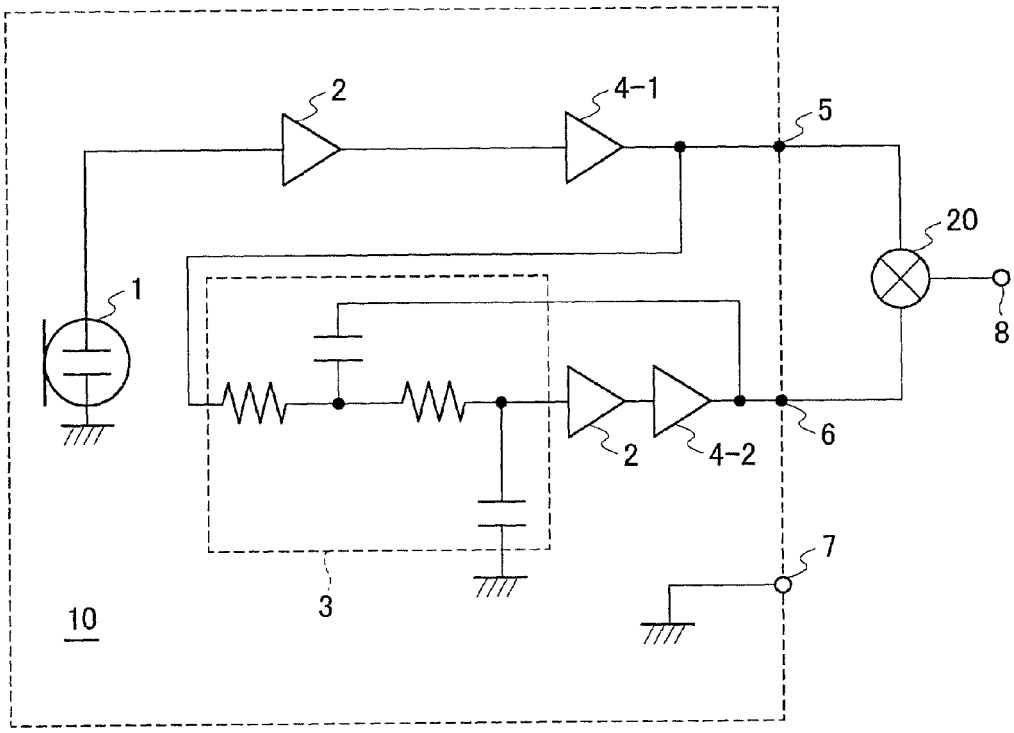
FIG. 1 is a simplified circuit diagram illustrating an embodiment of a microphone according to the present invention.

Embodiments of a microphone and a microphone device according to the present invention will now be described with reference to the accompanying drawings. FIG. 1 is a circuit diagram illustrating an example configuration of a microphone 10 according to the embodiment. As shown in FIG. 1, the microphone 10 includes a microphone unit 1, an impedance converter 2 disposed at a subsequent stage of the microphone unit 1, a low-pass filter circuit 3, and an output amplifier 4-1 and an output amplifier 4-2. The microphone unit 1, for example, is a condenser microphone unit.

The output from the microphone 10 is a balanced output. The output terminal is therefore a three-pin terminal including a HOT terminal 5, a COLD terminal 6, and a ground terminal 7. The impedance converter 2 and the output amplifier 4-1 are connected in series between the output terminal of the microphone unit 1 and the HOT terminal 5. The impedance converter 2, the output amplifier 4-1, the low-pass filter circuit 3, and the output amplifier 4-2 are connected in series between the output terminal of the microphone unit 1 and the COLD terminal 6. That is, no filter circuit is disposed between the microphone unit 1 and the HOT terminal 5 and a filter circuit is disposed between the microphone unit 1 and the COLD terminal 6. The low-pass filter circuit 3 reduces the high-frequency band component of the input electrical signal. The output signal from the COLD terminal 6 therefore does not contain the high frequency band component of the output signal from the microphone unit 1.

The HOT terminal 5 and the COLD terminal 6 are connected to input terminals of the mixer circuit 20 included in the output circuit. That is, the output signals from the respective output terminals (the HOT terminal 5 and the COLD terminal 6) of the microphone 10 are input to the mixer circuit 20. The mixer circuit 20 mixes and outputs the input signals. For example, the mixer circuit 20 subtracts the output signal derived from the COLD terminal 6 from the output signal derived from the HOT terminal 5 and outputs the resulting signal from the output terminal 8. The mixer circuit 20 and the microphone 10 make up the microphone device. The output terminal 8 is an output terminal of the microphone device.

Figure 2A:
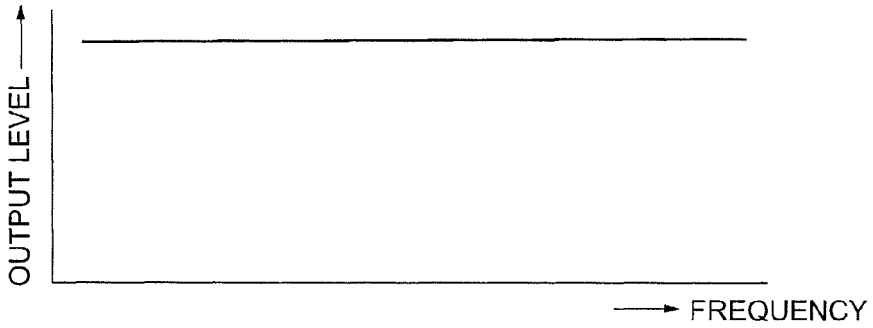
FIG. 2A is a diagram illustrating an example frequency response in the output from a HOT terminal in the microphone.
Figure 2B:
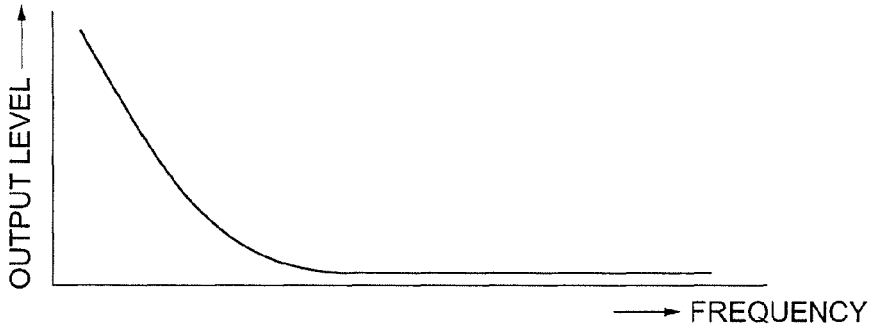
FIG. 2B is a diagram illustrating an example frequency response in the output from a COLD terminal in the microphone.
Figure 2C:
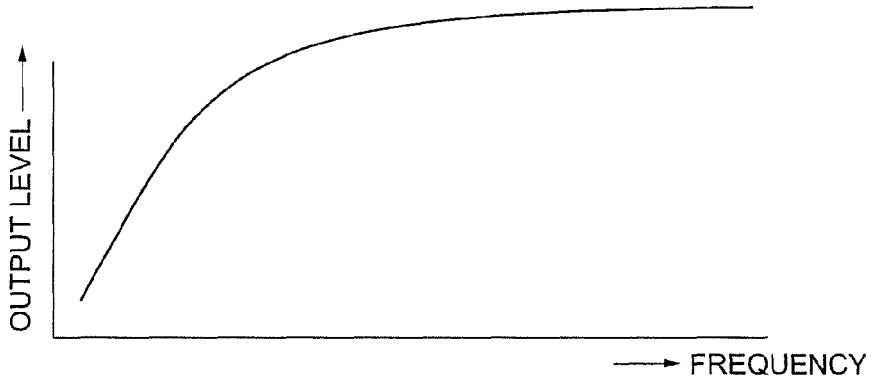
FIG. 2C is a diagram illustrating an example frequency response in the output from a mixer circuit in the microphone.

FIG. 2 is a diagram illustrating an example frequency response of the microphone 10. FIG. 2A illustrates an example frequency response in an output from the HOT terminal 5 of the microphone 10. FIG. 2B illustrates an example frequency response in an output from the COLD terminal 6 of the microphone 10. FIG. 2C illustrates an example frequency response in an output from the mixer circuit 20, i.e., an output from the microphone device. The horizontal axis in FIGS. 2A to 2C represents the frequency of signals and the longitudinal axis represents the level of signals.

As discussed above, the output signal from the HOT terminal 5 does not pass through a filter circuit. The output signal from the HOT terminal 5, therefore, has a constant signal level irrespective of the frequency, as shown in FIG. 2A. In contrast, the output signal from the COLD terminal 6 passed through the low-pass filter circuit 3. The output signal from the COLD terminal 6, therefore, has a high level at a low frequency band, and a low level at a frequency band above the cutoff frequency due to attenuation, as shown in FIG. 2B.

As discussed above, the mixer circuit 20 outputs a signal generated by subtracting the output signal derived from the COLD terminal 6 from the output signal derived from the HOT terminal 5. The signal from the output terminal 8 of the mixer circuit 20 is therefore a signal in which the low frequency band component of the output signal from the HOT terminal 5 and the low frequency band component of the output signal from the COLD terminal 6 are canceled. Thus, the level of the low frequency components below the cutoff frequency in the output signal from the output terminal 8 of the microphone device, as shown in FIG. 2C, is attenuated and reduced. As described above, in the output signal from the microphone device, the low frequency band components are cut at frequencies below the cutoff frequency and the noise components are attenuated.

A phase inverter that inverts the output signal from the output amplifier 4-2 may be connected to a subsequent stage of the output amplifier 4-2 and the mixer circuit 20 may be an adder. In this case, the HOT terminal 5 outputs a positive phase of output signal from the microphone unit 1. In contrast, the COLD terminal 6 outputs a signal that is a negative phase of output signal not containing high-frequency components from the microphone unit 1.

In this case, the signal that is added and output by the mixer circuit 20 is the difference between the positive phase component and the negative phase component. Thus, the output signal from the mixer circuit 20 in this case, i.e., the frequency response of the output signal from the microphone device is the frequency response similar to the frequency response illustrated in FIG. 2C.

The characteristics of the microphone 10 according to the embodiment will now be compared with the characteristics of a conventional microphone. The characteristics described below indicate the results measured under the same condition.

Figure 3:
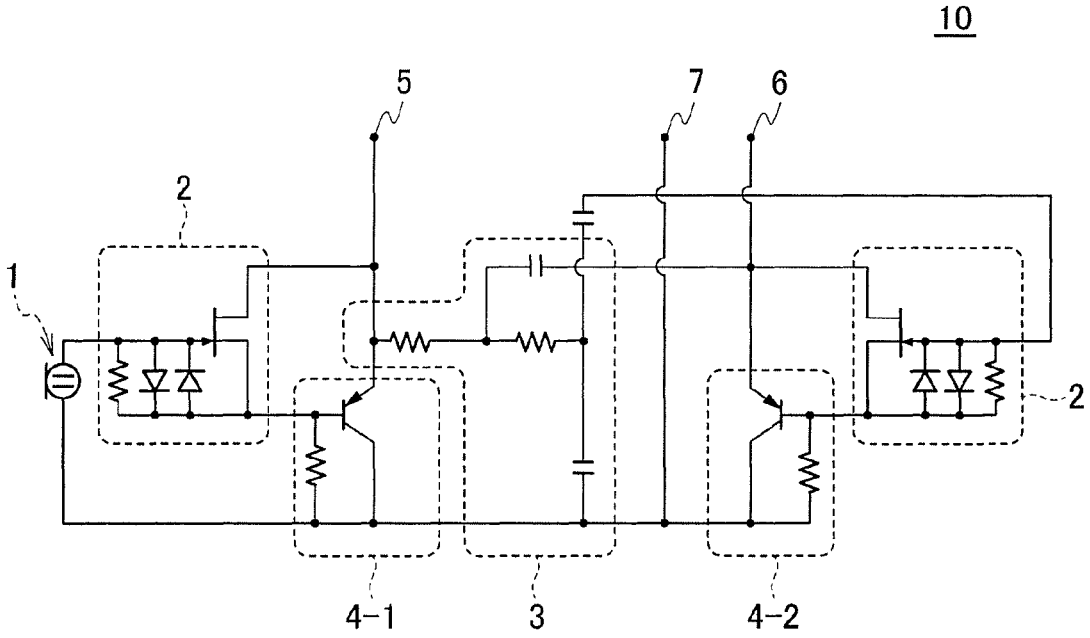
FIG. 3 is a circuit diagram illustrating a detailed example of a circuit configuration of the microphone used for measurement of frequency response.
Figure 4:
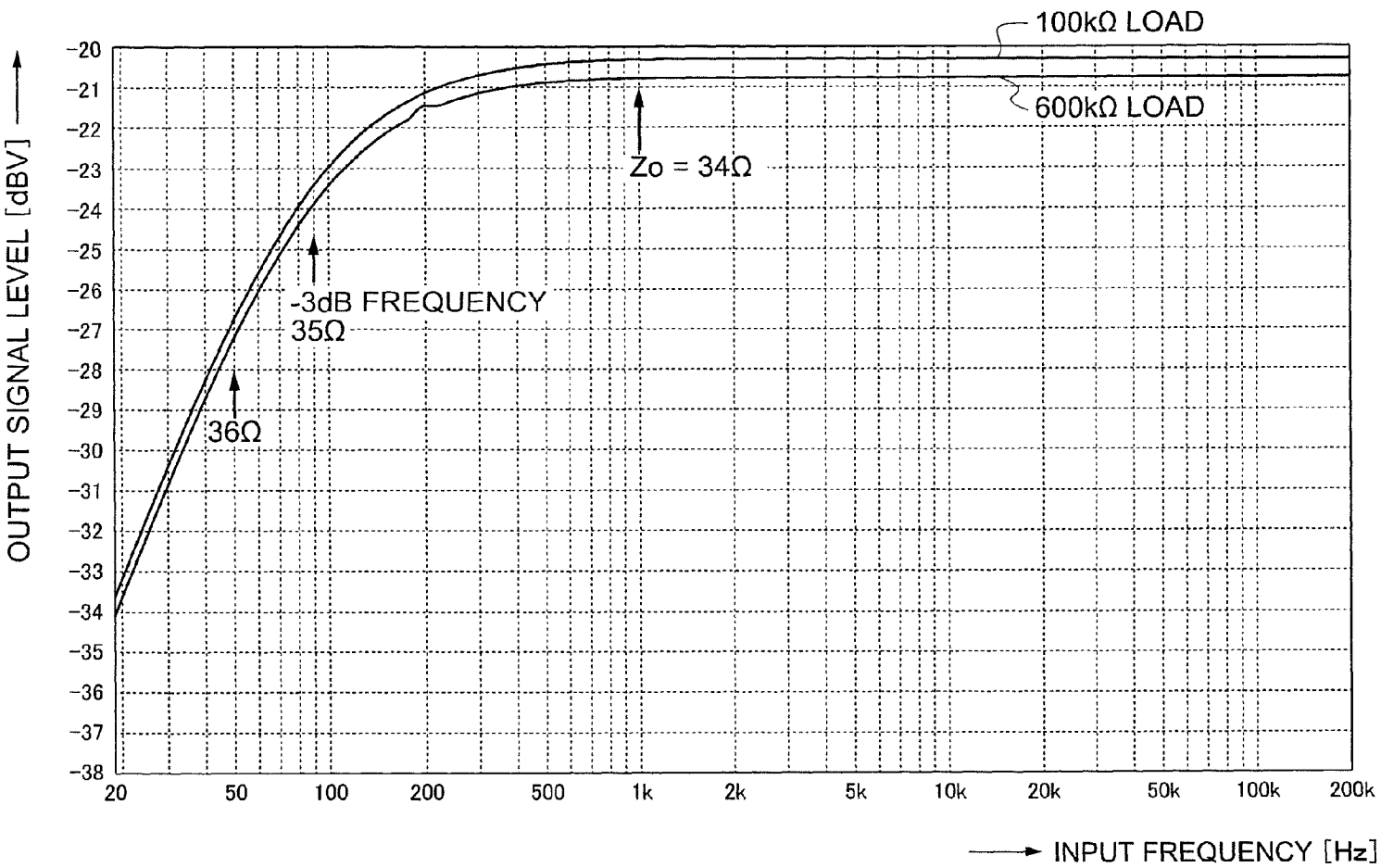
FIG. 4 is a diagram illustrating an example frequency response of the microphone.
Figure 7:
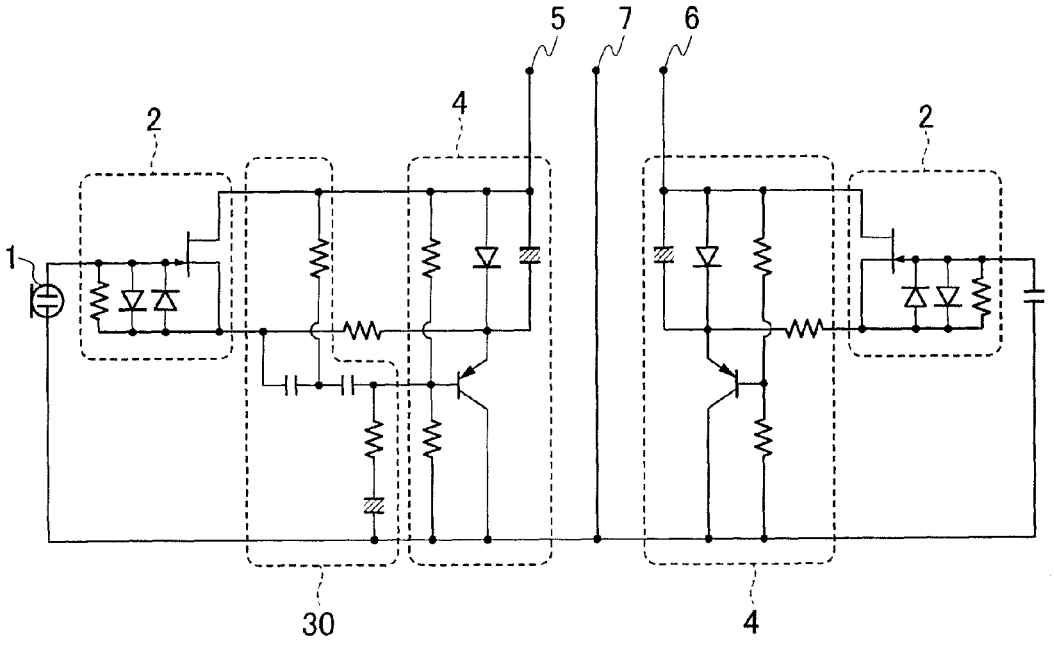
FIG. 7 RELATED ART
FIG. 7 is a circuit diagram illustrating a detailed example of a circuit configuration of a conventional microphone used for measurement of frequency response.
Figure 8:
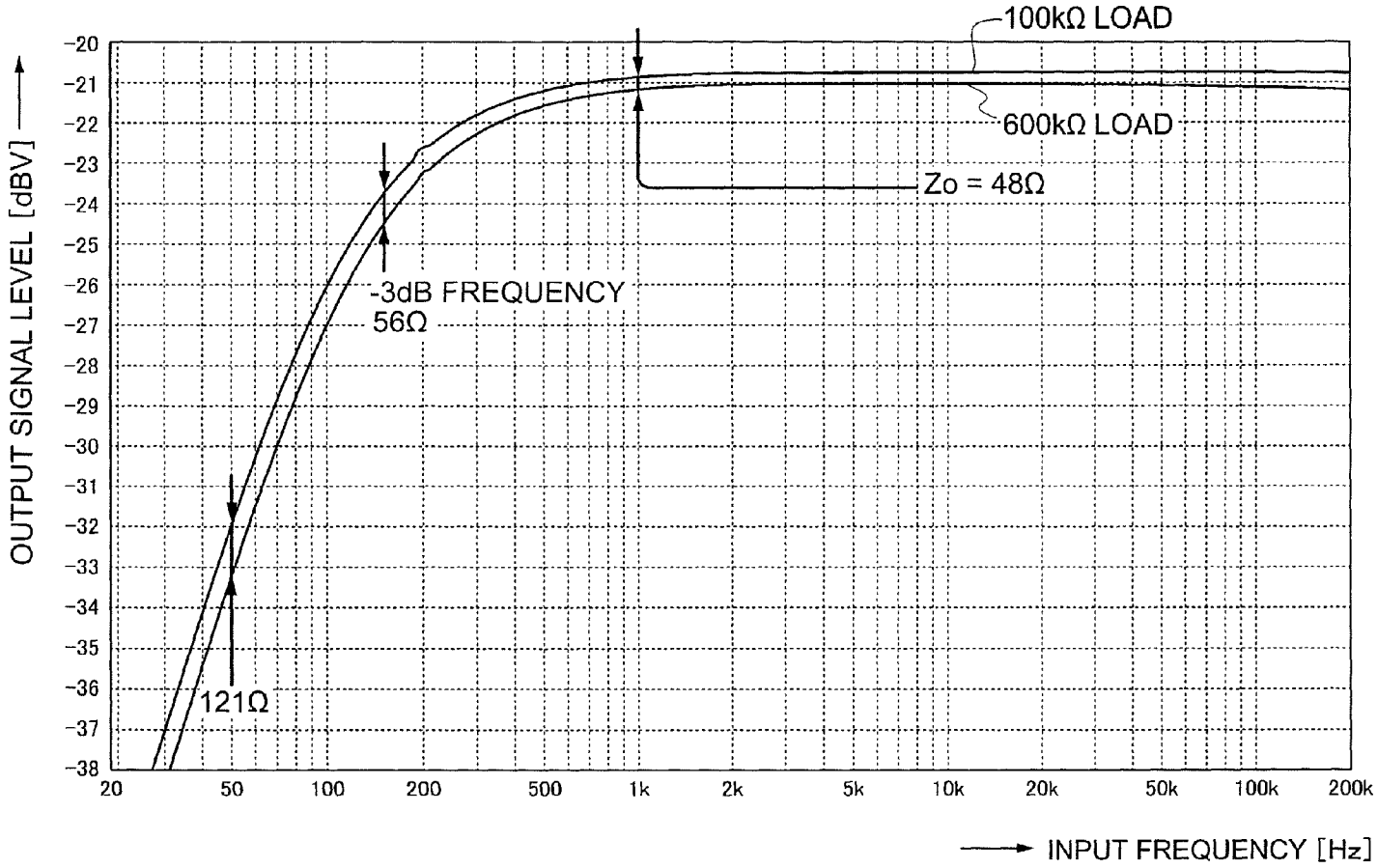
FIG. 8 RELATED ART
FIG. 8 is a diagram illustrating an example frequency response of a conventional microphone.
Figure 9:
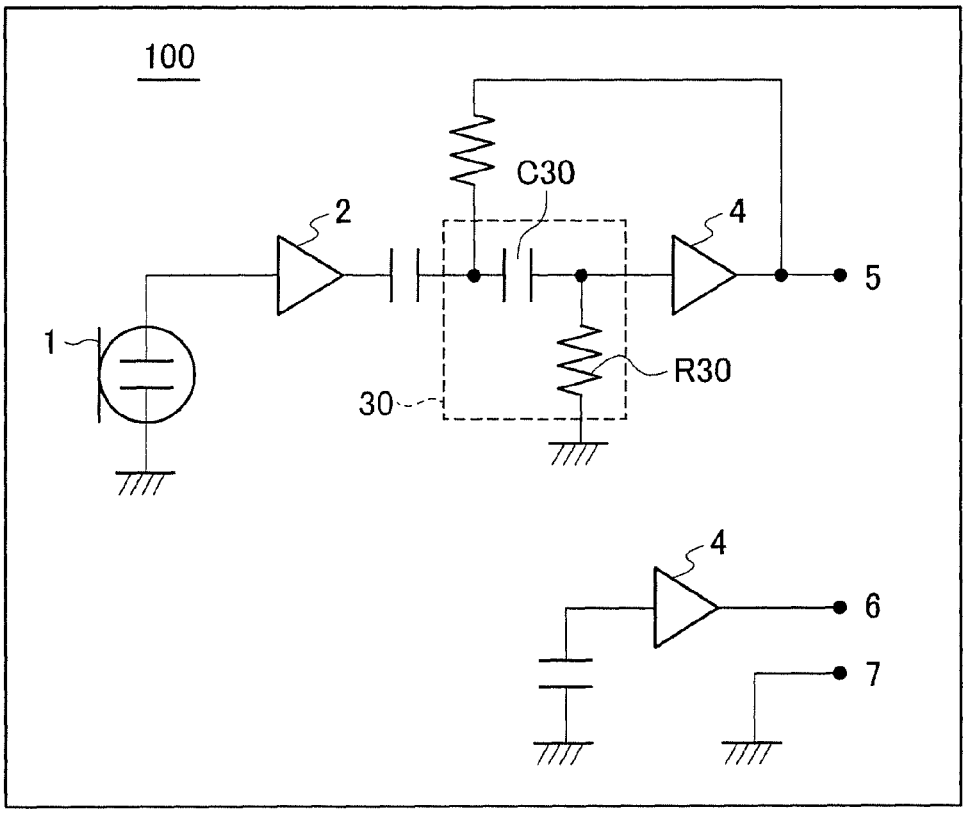
FIG. 9 RELATED ART
FIG. 9 is a simplified circuit diagram illustrating an example configuration of a conventional microphone.

FIG. 3 is a circuit diagram illustrating the detail of a circuit configuration of the microphone 10 used for measurement of the frequency response. FIG. 4 is a diagram illustrating an example frequency response of the microphone 10 illustrated in FIG. 3. FIG. 7 is a circuit diagram illustrating the detail of a circuit configuration of the conventional microphone 100 used for measurement of frequency response. FIG. 8 is a diagram illustrating an example frequency response of the microphone 100 illustrated in FIG. 7. Each of the frequency responses illustrated in FIGS. 4 and 8 is determined with a circuit for measurement connected to a load resistor of 100 kΩ or 600Ω. In the frequency responses of FIGS. 4 and 8, the horizontal axis represents the input frequency and the longitudinal axis represents the level of the output signals.

As shown in FIG. 8, the levels of the output signals in the conventional microphone 100 significantly vary dependent on the magnitude of the load resistor. The output impedance of the microphone 100 in each frequency can be calculated from the difference in the output levels. For example, although the output impedance is 48Ω at a frequency of the output signal of 1 kHz, the output impedance is 56Ω at a frequency (approximately 150 Hz in FIG. 8) when the output level of the output signal is attenuated by 3 dB. In addition, the output impedance is 121Ω at a frequency of the output signal of 50 Hz. As described above, the conventional microphone 100 tends to have high output impedance at a frequency lower than about 150 Hz, which is the cutoff frequency of the filter circuit.

Contrarily, the frequency response of the microphone 10 according to the embodiment is illustrated in FIG. 4 and the output level of the output signal is approximately constant irrespective of frequencies even if the load resistor is 100 kΩ or 600Ω. In other words, the microphone 10 according to the embodiment has a low fluctuation in output impedance dependent on frequencies. As shown in FIG. 4, the output impedance of the microphone 10 is 34Ω at a frequency of the output signal of 1 kHz. Contrarily, the output impedance is 35Ω at a frequency (approximately 90 Hz in FIG. 4) at which the output level of the output signal is attenuated by 3 dB and the output impedance is 36Ω at a frequency of 50 Hz.

As described above, the output impedance of the microphone 10 does not significantly vary in a frequency band lower than the cutoff frequency of the low-pass filter circuit 3. That is, the output impedance of the microphone 10 is approximately constant irrespective of the frequency of the output signal. Furthermore, the output impedance of the microphone 10 is kept at a low value. Thus, the microphone 10 can prevent the output impedance from increasing in response to the frequency of the output signal. The microphone 10 can thereby be less affected by exogenous noise due to the magnitude of the output impedance.

The output impedance of the HOT terminal 5 from which the positive phase of the output signal of the microphone unit 1 is output is sufficiently low. Since a signal is input from the HOT terminal 5 to the low-pass filter circuit 3, the output signal from the low-pass filter circuit 3 has no distortion even at a low impedance of the low-pass filter circuit 3.

Figure 5:
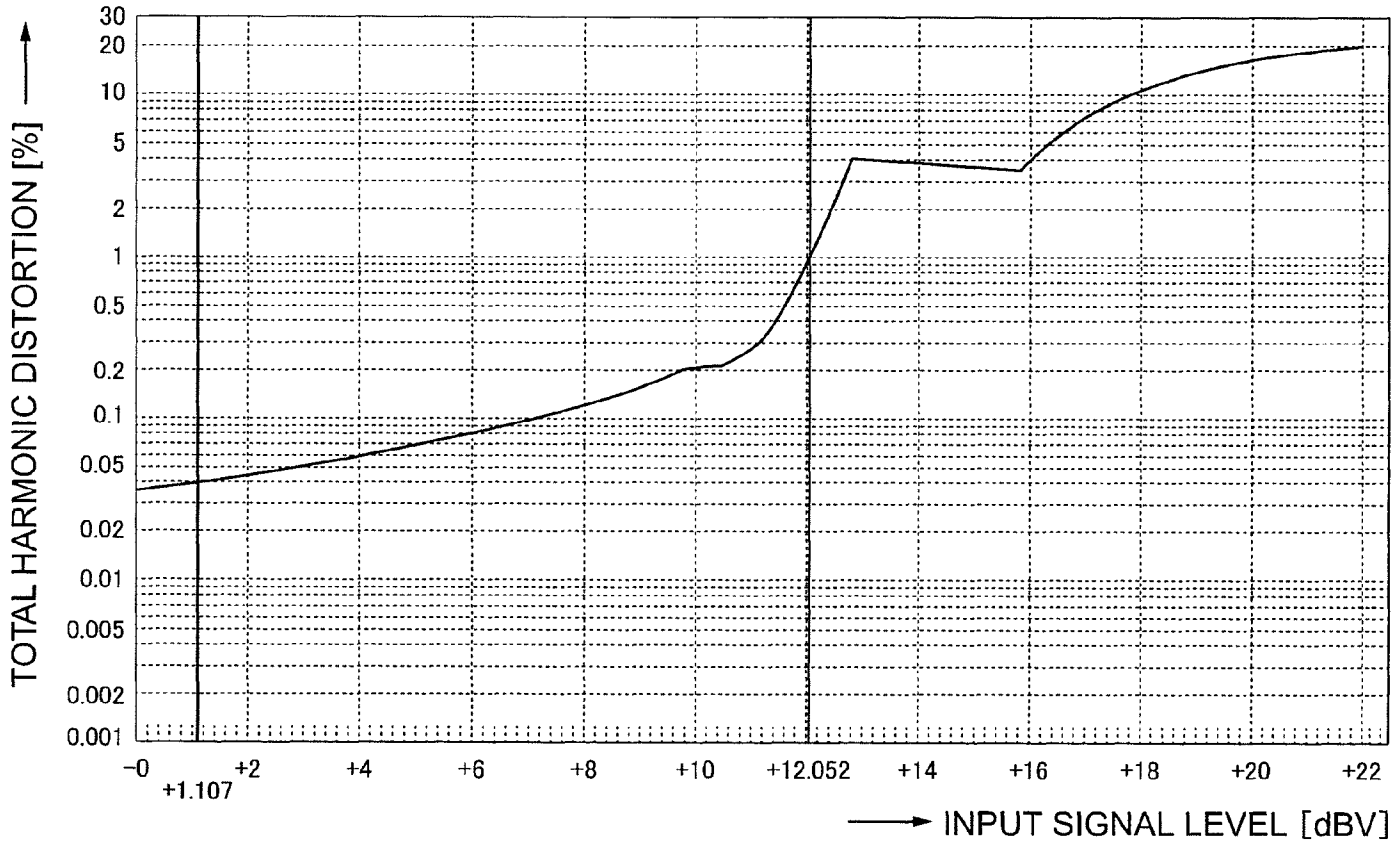
FIG. 5 is a diagram illustrating an example measurement of total harmonic distortion of the circuit.

The total harmonic distortion (THD) of the microphone 10 will now be described. FIG. 5 illustrates an example total harmonic distortion of the microphone 10 measured with the measuring circuit illustrated in FIG. 3. The total harmonic distortion can determine the level of the input signal as the tolerance (1% distortion) of distortion factor in the output signal.

As shown in FIG. 5, at a level of approximately +12 dB of the input signal to the microphone 10, the distortion factor of the output signal from the microphone 10 is 1%. The level of the input signal as the tolerance of the distortion factor of the microphone 10 is therefore very high.

Figure 6:
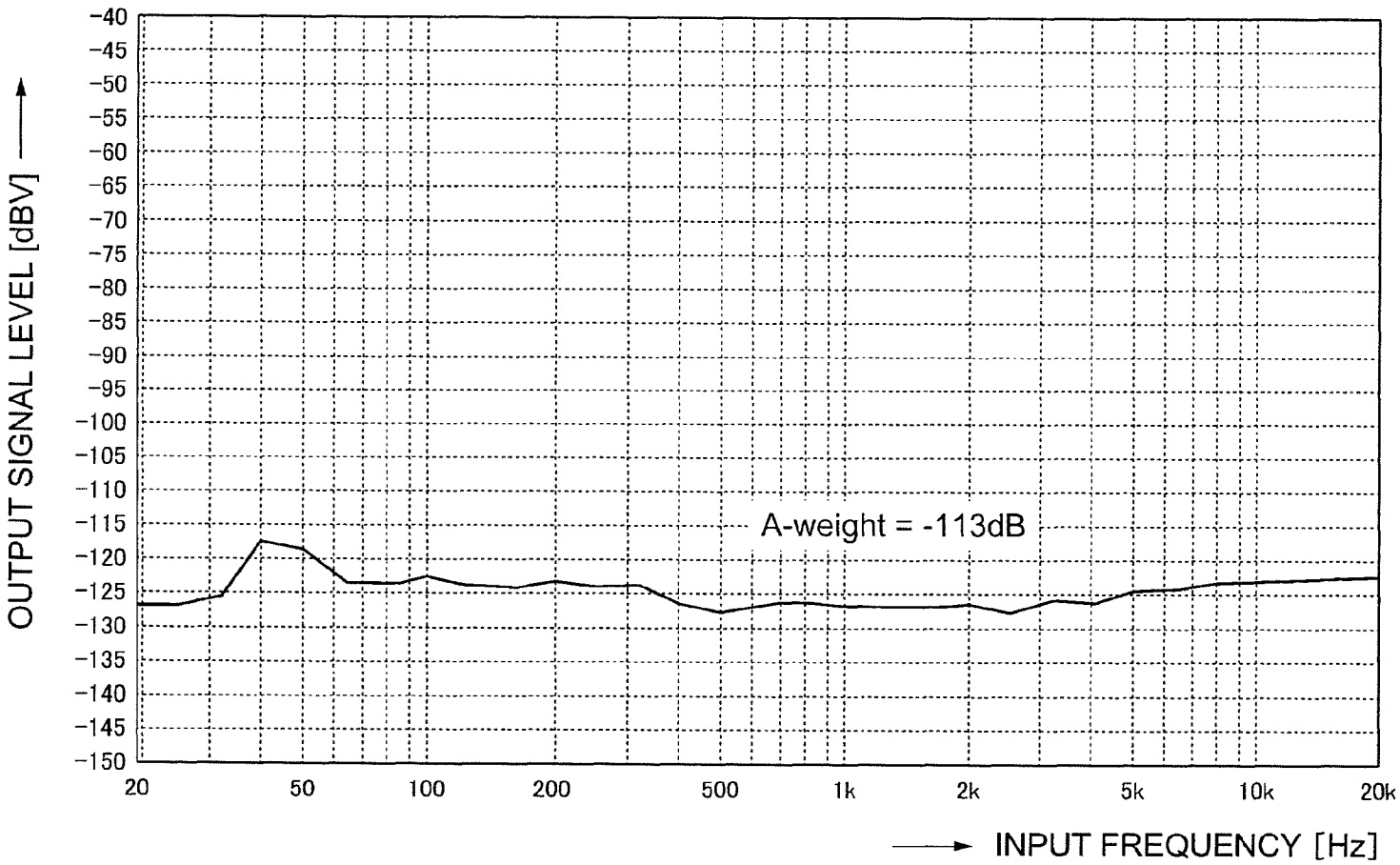
FIG. 6 is a diagram illustrating an example noise spectrum of the circuit.

A noise spectrum of the microphone 10 will now be described. FIG. 6 illustrates an example measurement of the noise spectrum of the microphone 10. As shown in FIG. 6, the A-weighted value of the microphone 10 is −113 dB.

The dynamic range is the difference between the level of the input signal having a distortion factor of 1% and the A-weighted value. The dynamic range of the microphone 10 is therefore approximately 125 dB (=12 dB−(−113 dB)). As described above, the microphone 10 can reduce the noise component through a reduction in the low frequency component included in the output signal using a simple circuit configuration. The output impedance of the microphone 10 does not increase independent from the frequency of the output signal. In addition, the microphone 10 has an increased dynamic range.

The invention claimed is:

1. A microphone comprising:

a microphone unit; and a HOT terminal and a COLD terminal that produce output signals of the microphone unit, wherein no filter circuit is disposed between the microphone unit and the HOT terminal, wherein a low-pass filter is disposed only between the microphone unit and the COLD terminal, the HOT terminal outputs the output signal from the microphone unit, the COLD terminal outputs the output signal from the microphone unit passed through the low-pass filter.

2. The microphone according to claim 1, further comprising a first impedance converter disposed between the microphone unit and the HOT terminal; and a second impedance converter disposed between the microphone unit and the COLD terminal, wherein the low-pass filter circuit is disposed between the second impedance converter and the COLD terminal.

3. The microphone according to claim 1, further comprising a GROUND terminal that is connected to a ground potential.

4. The microphone according to claim 2, further comprising a first output amplifier disposed between the first impedance converter and the HOT terminal; and a second output amplifier disposed between the low-pass filter circuit and the COLD terminal.

5. A microphone device comprising:

a microphone; and an output circuit including a mixer circuit that mixes and outputs signals input from the microphone, the microphone comprising:

a microphone unit; and, a HOT terminal and a COLD terminal that produce output signals of the microphone unit, wherein no filter circuit is disposed between the microphone unit and the HOT terminal, and a low-pass filter is disposed only between the microphone unit and the COLD terminal, and wherein the mixer circuit mixes and outputs signals output from each of a HOT terminal and a COLD terminal included in the microphone.

6. A microphone device according to claim 5, the microphone further comprising:

a first impedance converter disposed between the microphone unit and the HOT terminal; and, a second impedance converter disposed between the microphone unit and the COLD terminal, wherein the low-pass filter circuit is disposed between the second impedance converter and the COLD terminal.

7. The microphone according to claim 5, further comprising a GROUND terminal that is connected to a ground potential.

8. A microphone device according to claim 6, the microphone further comprising:

a first output amplifier disposed between the first impedance converter and the HOT terminal; and, a second output amplifier disposed between the low-pass filter circuit and the COLD terminal.

* * * * *